United States Patent [19]

Schneider et al.

[11] 4,349,310

[45] Sep. 14, 1982

[54] UNLOADING DEVICE FOR A PRESS

[75] Inventors: Franz Schneider, Göppingen; Burkhard Schumann, Ottenbach; Karl Maier, Kuchen; Herbert Höhn, Göppingen, all of Fed. Rep. of Germany

[73] Assignee: L. Schuler GmbH, Göppingen, Fed. Rep. of Germany

[21] Appl. No.: 972,214

[22] Filed: Dec. 22, 1978

[30] Foreign Application Priority Data

Dec. 23, 1977 [DE] Fed. Rep. of Germany ..... 2757629

[51] Int. Cl.[3] ..... B25J 9/00

[52] U.S. Cl. ..... 414/749; 100/207; 318/567

[58] Field of Search ..... 414/749, 751, 618, 416, 414/627, 591, 122; 318/567; 271/67; 100/207

[56] References Cited

U.S. PATENT DOCUMENTS

| | | | |
|---|---|---|---|
| 2,822,094 | 2/1958 | Greer | 414/749 X |
| 2,881,929 | 4/1959 | Giffen | 414/122 X |
| 2,942,736 | 6/1960 | Landsiedel | 414/749 X |
| 3,456,814 | 7/1969 | Bautz | 414/751 X |
| 3,575,301 | 1/1968 | Panissidi | 414/618 |
| 3,707,908 | 1/1973 | Merk | 414/749 X |
| 3,774,778 | 11/1973 | Flaig | 414/751 X |
| 3,834,555 | 9/1974 | Bennington | 414/627 |
| 3,884,363 | 5/1975 | Ajlouny | 414/751 X |
| 3,910,423 | 10/1975 | Killian | 414/591 |
| 3,951,271 | 4/1976 | Mette | 414/591 |
| 4,015,721 | 4/1977 | Scheler | 414/591 X |
| 4,124,242 | 11/1978 | Canner | 414/591 X |
| 4,132,318 | 1/1979 | Wang et al. | 414/618 X |

*Primary Examiner*—John J. Love
*Assistant Examiner*—Terrance L. Siemens
*Attorney, Agent, or Firm*—Craig and Antonelli

[57] ABSTRACT

In unloading a press, it is desirable to provide automatic unloading without the need for operators, even in situations requiring a definite stacking order in containers located next to the press. To achieve this automatic unloading, extraction grippers and a carrier frame are provided which can be moved in three directions which are at right angles to each other by servo drives controlled by a continuous-path numerical control unit.

9 Claims, 1 Drawing Figure

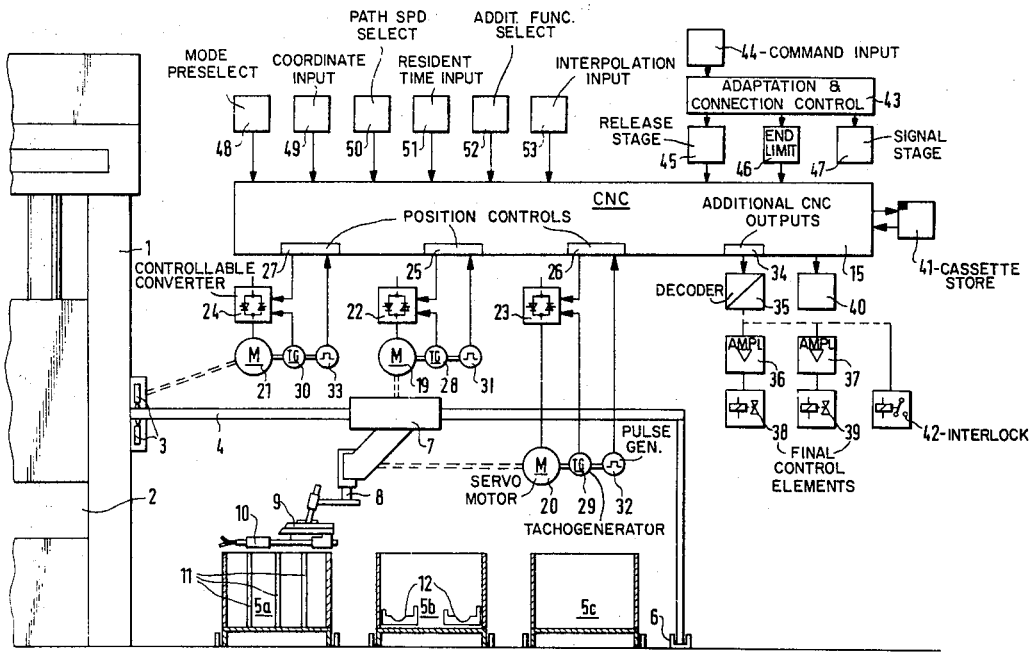

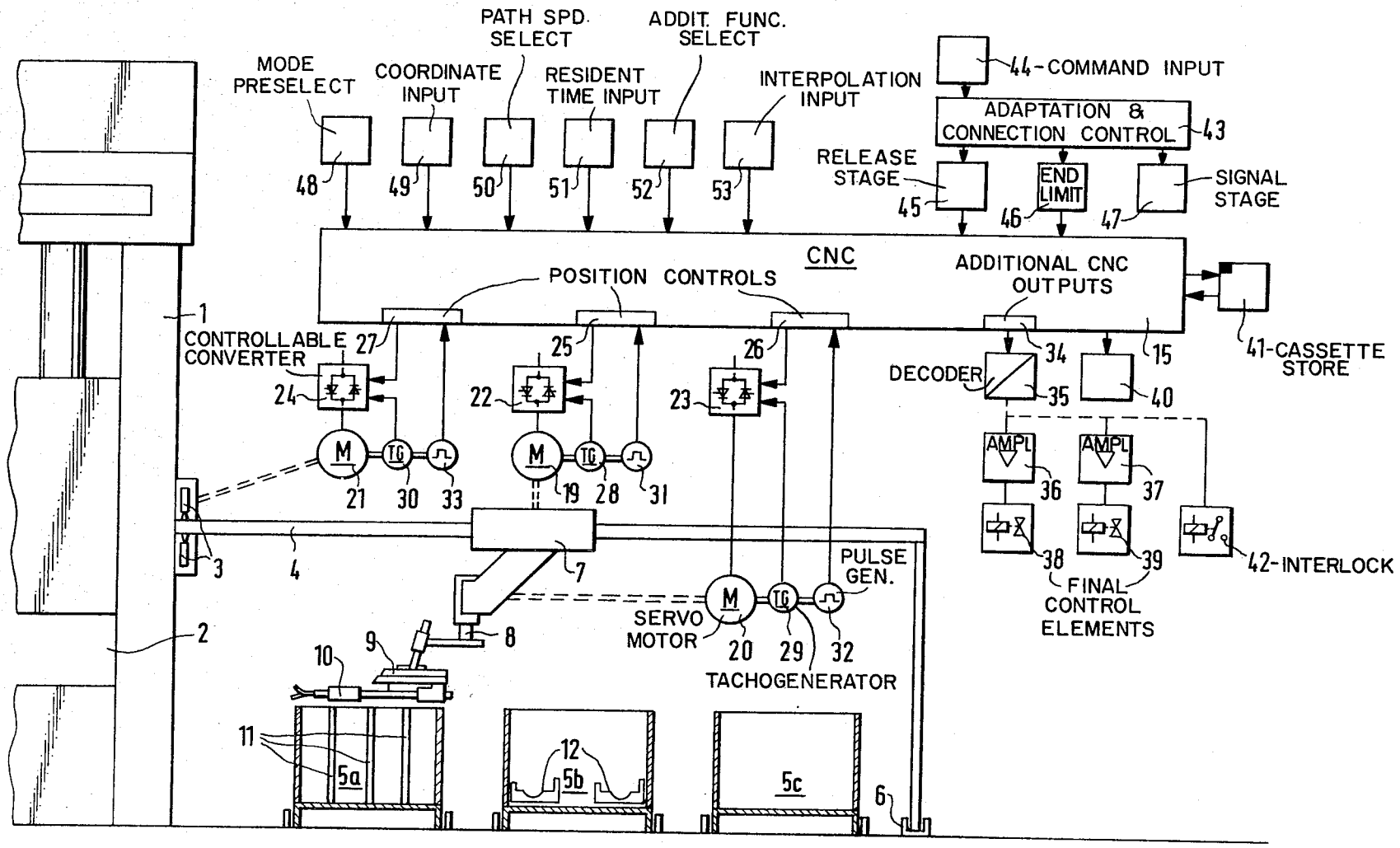
44-COMMAND INPUT
ADAPTATION & CONNECTION CONTROL
43
SIGNAL STAGE
47
END LIMIT
46
RELEASE STAGE
45
41-CASSETTE STORE
ADDITIONAL CNC OUTPUTS
15
40
34
35
DECODER
AMPL
37
36
39
38
42-INTERLOCK
FINAL CONTROL ELEMENTS
CNC
POSITION CONTROLS
INTERPOLATION INPUT
ADDIT. FUNC. SELECT
RESIDENT TIME INPUT
PATH SPD. SELECT
COORDINATE INPUT
MODE PRESELECT
53
52
51
50
49
48
26
25
27
23
22
24
31
28
19
33
30
21
CONTROLLABLE CONVERTER
PULSE GEN.
32
29
20
SERVO MOTOR
TACHOGENERATOR
7
8
9
10
4
3
1
2
6
5c
5b
5a
12
11

UNLOADING DEVICE FOR A PRESS

FIELD OF THE INVENTION

This invention relates to an unloading device for a press having extraction grippers for lifting workpieces out of the press and delivering them to containers.

DESCRIPTION OF THE PRIOR ART

Unloading devices of this kind are generally known and are, for example, illustrated and described in the VDI Guidelines 3245, March 1965, particularly pages 17 and 18, and in Deutsches-Gebrauchsmuster 75 38 022.

The extraction devices described in these prior publications are fastened to press pillars and are provided with extraction grippers which can be moved by drive elements independent of the press. In the course of the paths of movement of the extraction grippers it is customary to provide belt conveyors on which the processed workpieces lifted out of the tool and delivered out of the working chamber of the press are deposited. By means of the belt conveyor the workpieces are carried away and, for example in the case of parts which are not critical with respect to their surface nature, are discharged in random order into a transport container. However, when the parts are critical with respect to the nature of their surface, as for example in the case of outer cladding parts of a motor vehicle, one or more operators are required to stand at the end of the belt conveyor and pack the workpieces manually into a transport container.

SUMMARY OF THE INVENTION

Accordingly, it is an object of the present invention to provide an extraction device which does not require a belt conveyor and which is capable of automatically stacking workpieces discharged from a press in an ordered arrangement.

To accomplish this and other objects, a press unloading device is provided having a carrier frame extending over containers located alongside the press. Extraction grippers are mounted on this carrier frame, and are movable in two planes which are at right angles to one another so that the grippers can be moved to lift workpieces out of the press and deliver them to the containers. Servo drives are coupled to the carrier frame and the extraction grippers. These servo drives are controlled by a continuous-path numerical control unit in accordance with a predetermined program to control the movement of the carrier frame and the extraction grippers automatically.

A substantial advantage of the extraction device according to the present invention is that the workpieces are automatically and continuously stacked in order in the transport container, so that fully automatic operation is possible. This is especially important in automated press lines. Another advantage is gained in the further processing of the workpieces which have been stacked in order, particularly in the simplification of handling during subsequent processing operations.

BRIEF DESCRIPTION OF THE DRAWING

Other objects and advantages of the present invention may be more clearly understood by reference to the following detailed description and drawing wherein the sole FIGURE shows one example of an unloading device according to the present invention.

DETAILED DESCRIPTION

Referring now to the drawing, a press 1 is shown having guide rails 3 disposed above the working chamber 2 on an outlet side of the press 1. These guide rails 3 extend in the horizontal direction. A carrier frame 4 is mounted for travelling in these guide rails 3. The carrier frame 4 is, in addition, mounted in a running rail 6, and extends in an L-shape over a plurality of containers 5*a*, 5*b*, and 5*c* which will be described in greater detail below.

A conveyor carriage 7 is mounted in the carrier frame 4 for running on a track (not shown). A carrier 9 is mounted on the conveyor carriage 7 so as to be adjustable in position by means of a guide element 8 which transmits raising and lowering movement to the carrier 9. Extraction grippers 10, which are in the form of gripper tongs, are mounted on the carrier 9 itself. The containers 5*a*, 5*b*, and 5*c* constitute transport containers, which are so shaped that the workpieces can be stacked in accordance with their shape. Thus, for example, the first container 5*a* following the press 1 may have receiving bars 11 provided for this purpose, while the second container 5*b* may have profiled holders 12.

The unloading device described so far is controlled with the aid of a continuous-path numerical control unit (hereinafter referred to as a CNC 15), which is constructed in a known manner with a process control computer and store units. One example of a commercially available unit for this purpose is the Simumerik Mate M, manufactured by Siemans, Inc. for drilling and milling machines. On the output side of the CNC 15, three positioning controls 25, 26, and 27 are integrated in the CNC control, each of them being associated with a servo drive 19, 20, and 21. The servo drive 19 effects the horizontal movement of the common conveyor carriage 7, while the servo drive 20 brings about the vertical movement of extraction grippers 10 mounted on the conveyor carriage 7. The servo drive 21 controls the position of the carrier frame 4 along guide rail 3. The positioning control circuits of the servo drives 19, 20, and 21 are all of identical construction, and each has a controllable converter 22, 23, and 24 respectively, which receive a desired value from corresponding positioning controls 25, 26, and 27 and an actual value (e.g. speed) from a tachogenerator 28, 29, and 30 corresponding to the respective servo drives 19, 20, and 21. In addition, incremental pulse generators 31, 32, and 33 are associated with the servo drives 19, 20, and 21 to provide the positioning controls 25, 26, and 27 with the actual position value at any given moment.

The desired position value is determined by the CNC control 15, and then processed with the actual position value. The resultant signal is then transmitted to the controllable converters 22, 23, and 24. In addition to the positioning controls 25, 26, and 27, the CNC control 15 also has additional signal outputs 34 which, via a decoder 35 and amplifiers 36 and 37, are connected to final control elements 38 and 39. The final control elements 38 and 39 may, for example, be valves which effect the opening and closing of the extraction grippers 10.

On a digital display 40 typical characteristic values of the workpiece transport device can be displayed. The CNC control 15 also has associated with it a cassette store input 41, by means of which programs can be changed without difficulty by changing the cassette.

The signal outputs 34 also control an interlock circuit 42, which is operated by way of the decoder 35 to lock the actual press control (not shown) in such a manner that the starting of the press 1 is reliably prevented as long as the extraction grippers 10 are in the immediate proximity of the press.

The input side of the CNC control 15 has, on the one hand, an adaptation and connection control 43, whose essential task consists in connecting the press control to the CNC control 15. For this purpose the adaptation control 43 has associated with it a command input 44, to which signals typical of the press operation are fed, such as position signals or tool loading and unloading signals. The Logitrol control system described in General Electric brochure GEA-9478A is one example of a unit which can be used as the adaptation and connection control 43. A release stage 45, by which the servo drives 19, 20 and 21 are started, and an end position limiting stage 46, by which the conveyor carriage 7 is prevented from overrunning extreme end positions (to thus avoid damage or breakdowns) are connected downstream of the adaptation control 43 but upstream of the CNC control 15. At the same time, the adaptation control 43 operates a signalling stage 47 which, with the aid of devices such as light-emitting diodes, displays the progress of functioning of the unloading device within a function flow diagram.

The CNC control 15 also contains directly associated input stages of a mode preselection stage 48, a coordinate input stage 49 for the points to be reached by the servo drives 19, 20, and 21, a path speed selection stage 50, a residence time input stage 51, an additional function selection stage 52, and an interpolation input stage 53. Through these input stages 48 to 53 the movement cycle of the unloading device can be fed in manually.

For example, by means of the mode preselection stage 48, it is possible to preselect set-up operation, continuous operation, and so on, while by means of the coordinate input stage 49, the destination points are determined. With the aid of the interpolation input stage 53, it is determined how the preselected points will be reached. for example, these points can be reached either directly linearly (that is, on the shortest path), on circular arcs, or according to the type of path control.

The operation of a press 1 provided with the unloading device of the invention and the CNC control 15 will now be described.

By means of a loader (not shown) the press 1 is loaded with a workpiece. On completion of processing in the press 1, when the main drive of the press is at a crankshaft angle of about 270°, a signal is passed through the command input 44 to the adaptation control 43, whereby the release stage 45 is set. The desired position values determined by the CNC control are then approached by the servo drives 19 and 20, and the workpiece is lifted out of the tool by means of the extraction grippers 10, delivered out of the working chamber 2, and deposited at the lowermost position, which is to be operated first, in the first container 5*a* following the press 1. The next workpiece is then, for example, deposited behind the first, likewise at the lowermost point in the container 5*a*. When the lowermost layer has been completely filled, the extraction grippers 10 are accordingly controlled to deposit workpieces in the next higher layer. This operation continues until the container 5*a* is completely full. The CNC control 15 then controls the extraction grippers 10 to deposit workpieces in the second container 5*b* which is filled in the same manner as previously described, while the container 5*a*, which has now been filled, can be replaced by an empty container. The container 5*c* serves in the present example as a reserve, which will be used only if the changing of the preceding containers 5*a* and 5*b* takes longer than the time that should be required for the filling of two containers.

By means of the servo drive 21 it is, in addition, possible for two or more layers to be stacked side by side on one container in the case of relatively small workpieces. This is accomplished by moving the carrier frame 4 in the guide rail 3 to thereby move the carriage 7 and the extraction grippers 10.

With the aid of the unloading device with CNC control 15 automatic ordering, magazined stacking of even complicated workpieces is possible without damaging their surfaces. This is particularly advantageous in an automated press line.

The CNC control 15 is programmed either manually through the input stages 48 to 53 or by changing, for example, a solid state store in the cassette store input 41.

For certain applications, the servo drives 19, 20, and 21 can be constructed with linear motors, in which case, for example, the conveyor carriage 7 is moved with positioning control in the end regions of the carrier frame 4, while in the relatively large intermediate region of the frame it is moved without such control.

An unloading device according to the invention can likewise be used to advantage for quality-orientated stacking, in which case the containers 5*a*, 5*b* and 5*c* can also be disposed side by side.

It is to be understood that the above-described arrangements are simply illustrative of the application of the principles of this invention. Numerous other arrangements may be readily devised by those skilled in the art which embodies principles of the invention and falls within its spirit and scope.

We claim:

1. An unloading device for moving workpieces from a press into containers located alongside the press, comprising:

a carrier frame extending over the containers;

a guide rail mounted on the side of the press, wherein one end of the carrier frame is inserted in said guide rail for movement in a first direction along the side of the press;

extraction grippers mounted on said carrier frame wherein said extraction grippers can be moved laterally outside of an area under said carrier frame into a working area of the press to lift workpieces out of the press and deliver them to the containers; and a plurality of servo drives coupled to the carrier frame and the extraction grippers to move said extraction grippers in three directions which are at right angles to each other, said servo drives being controlled by a continuous-path numerical control unit in accordance with a predetermined program to control the movement of said carrier frame and said extraction grippers to direct the extraction grippers into the working area of the press to lift the workpieces out of the press and move them into the area under the carrier frame to stack the workpieces in order in the containers alongside the press according to control signals from the numerical control unit.

2. An unloading device according to claim 1, wherein the containers are provided with workpiece holders corresponding to the, contour of the workpieces.

3. An unloading device according to claim 1, further comprising an additional guide rail located alongside the containers, wherein the other end of the carrier frame is inserted in said additional guide rail.

4. An unloading device according to claim 1, further comprising:

a carriage mounted for movement in a second direction along the carrier frame; and a carrier mounted on a guide element which is part of the carriage for movement in a third direction along said guide element, wherein said extraction grippers are mounted on said carrier;

and further wherein said plurality of servo drives comprise a first servo drive coupled to the carrier frame to move it in said first direction along said guide rail, a second servo drive coupled to said carriage to move it in said second direction along said carrier frame, and a third servo drive coupled to said extraction grippers to move them in said third direction along said guide element.

5. An unloading device according to claim 1, wherein the continuous-path numerical control unit further comprises a plurality of positioning control circuits coupled to the servo drives for providing desired drive signals to said servo drives.

6. An unloading device according to claim 5, further including means coupled between the servo drives and the positioning control circuits for indicating actual drive signals, and comparison means for receiving and comparing the desired drive signals from said positioning control circuit and the actual drive signals from said indicating means, wherein said comparison means generate resultant signals based on said comparisons to control said servo drives.

7. An unloading device according to claim 1, further comprising:

valves coupled between the continuous-path numerical control unit and the extraction grippers to control the extraction grippers in accordance with commands from the continuous-path numerical control unit.

8. An unloading device according to claim 1, further comprising adaptation and control means coupled to the continuous-path numerical control unit for coupling press operation control signals to the continuous-path numerical control unit.

9. An unloading device according to claim 1, wherein a plurality of containers are provided having workpiece holders which correspond to different contours of a plurality of workpieces, and wherein said numerical control unit controls the orderly stacking of workpieces into said containers so that said workpieces are stacked in a container having workpiece holders conforming to their contour.

* * * * *